United States Patent [19]

Otoguro et al.

[11] 4,405,369

[45] Sep. 20, 1983

[54] FERRITIC HEAT-RESISTING STEEL WITH AN EXCELLENT TOUGHNESS

[75] Inventors: Yasuo Otoguro, Machida; Katukuni Hashimoto, Sagamihara; Hisashi Takahashi; Toshio Fujita, both of Tokyo, all of Japan

[73] Assignee: Nippon Steel Corporation, Tokyo, Japan

[21] Appl. No.: 288,397

[22] Filed: Jul. 30, 1981

[30] Foreign Application Priority Data

Jul. 30, 1980 [JP] Japan ..... 55-104779

[51] Int. Cl.[3] ..... C22C 38/22; C22C 38/24; C22C 38/26

[52] U.S. Cl. ..... 75/126 C; 75/126 E; 75/126 F; 75/126 G

[58] Field of Search ..... 75/126 C, 126 E, 126 F, 75/126 G; 148/12 EA

[56] References Cited

U.S. PATENT DOCUMENTS 3,539,338 11/1970 Mimino et al. ..... 75/126 C
3,926,622 12/1975 Kiyonaga et al. ..... 75/128 E
4,222,771 9/1980 Oda et al. ..... 75/126 C

FOREIGN PATENT DOCUMENTS 2447137 4/1975 Fed. Rep. of Germany ... 75/126 G

*Primary Examiner*—Peter K. Skiff
*Attorney, Agent, or Firm*—Kenyon & Kenyon

[57] ABSTRACT

A ferritic heat-resisting steel with an excellent toughness comprises 0.03 to 0.10% by weight of carbon,
0.1 to 1.0% by weight of silicon,
1.5% by weight or less of manganese,
1.5% to 2.7% by weight of molybdenum,
7.0% to 10.0% by weight of chromium,
0.01 to 0.1% by weight of niobium,
0.02 to 0.12% by weight of vanadium,
0.01 to 0.10% by weight of alloying element consisting of at least one member selected from the group consisting of rare earth elements having atomic numbers 57 through 71 and yttrium, and the balance consisting of iron and unavoidable impurities, in which steel the ratio of the sum of the numbers of niobium and vanadium atoms to the number of carbon atoms is in the range of from 0.35 to 0.80; and the quantity (Cr%/30+Mo%/10−C%) and the content in percent of said alloying element fall on or within an irregular pentagon indicated in FIG. 1, the irregular pentagon being defined by the following points of A, B, C, P and D,

| Coordinate | $\left(\frac{Cr\ \%}{30} + \frac{Mo\ \%}{10} - C\ \%\right)$ | Alloying element (The Sum of REM and Y content) (%) |
|---|---|---|
| A | 0.28 | 0.10 |
| B | 0.28 | 0.01 |
| C | 0.52 | 0.01 |
| P | 0.57 | 0.055 |
| D | 0.52 | 0.10 |

9 Claims, 2 Drawing Figures

FERRITIC HEAT-RESISTING STEEL WITH AN EXCELLENT TOUGHNESS

FIELD OF THE INVENTION

The present invention relates to a ferritic heat-resisting steel with an enhanced toughness. Particularly, the present invention relates to a ferritic heat-resisting steel with an excellent resistance to creep at an elevated temperature, satisfactory weldability and formability and a reduced deterioration in tonghness even after being subjected to a stress for a long period of time.

BACKGROUND OF THE INVENTION

Recently, as thermoelectric power stations become larger in size there is an increasing demand for a boiler capable of being operated at high temperatures and pressures. In general, when steam having a temperature exceeding 550° C. is to be generated in a boiler, such a boiler should be made not of a conventional 2¼Cr-1Mo steel, but of a high quality steel, such as a 18-8 stainless steel, having a remarkably enhanced resistance to oxidation and mechanical strength at an elevated temperature, as compared with the 2¼-Cr-1Mo steel.

However, stainless steel is far more expensive than a low-alloyed steel. Therefore, the use of stainless steel results in an increase in the cost of the boiler production. From such an economical point of view, usually, the operational temperature of the boiler is limited so that the temperature of steam generated from the boiler does not exceed 550° C. Under these circumstances, in order to enhance the boiler efficiency, a super critical boiler, which is operated at a pressure higher than the critical pressure of water, is used.

On the other hand, for the past thirty to forty years, various research has been made to develop a middle-graded steel between the 2¼-Cr-1Mo steel and the austenitic stainless steel. For example, attention was paid to boiler steel tubes having an intermediate content of chromium between that in the 2¼Cr-1Mo steel and that in the stainless steel, such as a 5Cr, 9Cr or 12Cr tube. Although this type of boiler steel tube has a satisfactory mechanical properties at an elevated temperature, the weldability and formability thereof are inferior. Therefore, in order to improve the weldability and formability of the steel tube, extensive studies were made. However, no satisfactory result was obtained. Therefore, the use of such a steel is necessarily accompanied by a significant low efficiency of construction for the boiler. In practice, the above-mentioned steel tube has not been used in the world except for a small area in Europe.

Under these circumstances, there is a strong desire for the development of an inexpensive heat-resisting steel having an intermediate creep rupture strength between that of the 2¼Cr-1Mo steel and that of the austenitic stainless steel.

In view of the above, the inventors of the present invention made extensive studies to develop a novel steel having an enhanced weldability and formability and a remarkably enhanced creep rupture strength, over those of the conventional boiler steel materials. As a result of this, the inventors of the present invention found that a reduced content of carbon is liable to reduce the toughness of the resultant steel during the use thereof. Therefore, in consideration of the balance between the contents of the alloying elements to be contained, the inventors of the present invention created a new type of ferritic steel.

SUMMARY OF THE INVENTION

An object of the present invention is to provide a ferritic heat-resisting steel with an excellent toughness and exhibiting excellent weldability and formability.

Another object of the present invention is to provide a ferritic heat-resisting steel with an excellent toughness and exhibiting a superior creep rupture strength at an elevated temperature.

The further object of the present invention is to provide a ferritic heat-resisting steel with an excellent toughness and a proper price for practical use.

The above-mentioned objects can be attained by the ferritic heat resistance steel of the present invention with an excellent toughness, which comprises 0.03 to 0.10% by weight of carbon,
0.1 to 1.0% by weight of silicon,
1.5% by weight or less of manganese,
1.5% to 2.7% by weight of molybdenum,
7.0% to 10.0% by weight of chromium,
0.01 to 0.1% by weight of niobium,
0.02 to 0.12% by weight of vanadium,
0.01 to 0.10% by weight of an alloying element consisting of at least one member selected from the group consisting of rare earth elements (REM) having atomic numbers 57 through 71 and yttrium, and the balance consisting of iron and unavoidable impurities, and in which the ratio of the sum of the numbers of niobium and vanadium atoms to the number of carbon atoms is in the range of from 0.35 to 0.80; and the quantity (Cr%/30+Mo%/10−C%) and the content in % of said alloying elements fall on or within an irregular pentagon indicated in FIG. 1, said irregular pentagon being defined by points of A, B, C, P and D,

| Coordinate | $\left(\frac{Cr\ \%}{30} + \frac{Mo\ \%}{10} - C\ \%\right)$ | Alloying element (The Sum of REM and Y content) (%) |
|---|---|---|
| A | 0.28 | 0.10 |
| B | 0.28 | 0.01 |
| C | 0.52 | 0.01 |
| P | 0.57 | 0.055 |
| D | 0.52 | 0.10 |

DETAILED DESCRIPTION OF THE INVENTION

Figure 1:
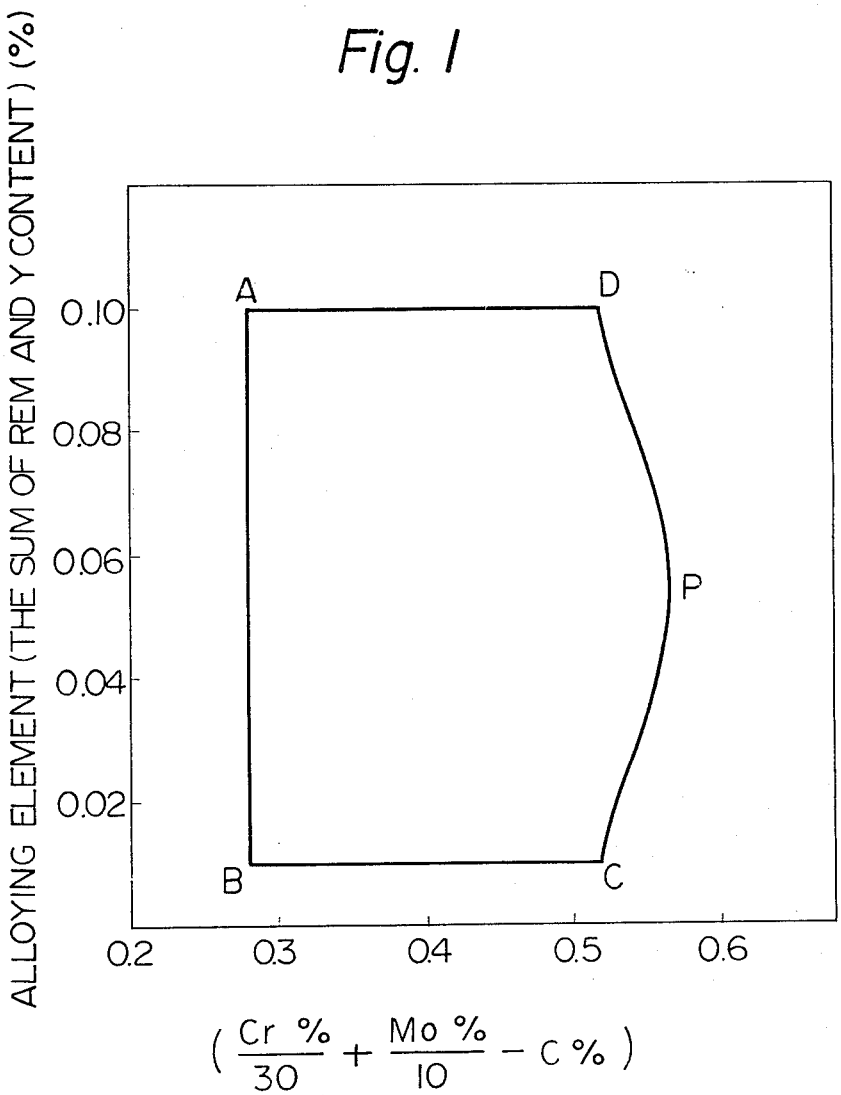
FIG. 1 shows the optimal ranges of (Cr%/30+Mo%/10−C%) and the total content of rare earth elements and Y determined from the standpoints of creep rupture strength and embrittlement during service.

The characteristic feature of the ferritic steel of the present invention is the largely reduced carbon content for enhanced weldability and formability, the reduction in mechanical strength due to the reduced carbon content being recovered by precipitation of an adequate amount of carbides. At least, one of rare earth elements of atomic numbers 57 through 71 and yttrium is added in an adequate amount with balanced amounts of chromium, molybdenum and carbon for suppressing embrittlement of the steel during high temperature service.

That is, in the ferritic steel according to the present invention, the content of carbon is limited to 0.10% by weight or less in order to ensure an enhanced weldability and formability. Also, for the purpose of ensuring an enhanced creep rupture strength even at such a reduced carbon content, the contents of niobium and vanadium are controlled to an adequate level in correspondence with the carbon content, and carbide precipitation condition is controlled to prevent the carbide particles from coarsening even after a long term service. Therefore, the steel of the present invention has a remarkably enhanced creep rupture strength in spite of its reduced carbon content.

There exist optimal ranges of the contents of vanadium and niobium in relation to the carbon content, and their optimal ratios to carbon content for controlling the state of carbide precipitation. Embrittlement of the steel during service is related with the metallurgical structure of the steel, and the type and precipitation condition of carbides. The inventors of the present invention investigated the effect of the relationship between the contents of chromium and molybdenum and the contents of carbon and vanadium from the standpoint of embrittlement of the steel. As a result, the inventors of the present invention found that when the contents of chromium and molybdenum are increased, it is necessary to simultaneously increase the content of carbon for the purpose of preventing embrittlement of the steel.

Also, the inventors of the present invention investigated the effect of the alloying elements on toughness, particularly the toughness after heating for a long period of time, of the steel. As a result of this investigation, it was found that rare earth elements having atomic numbers 57 through 71 and yttrium in an amount in correspondence with the amounts of chromium, molybdenum and carbon are very effective as an alloying element capable of enhancing the toughness of the steel without dropping the mechanical strength thereof.

On the basis of the above mentioned facts, the inventors succeeded in providing the novel type of ferritic heat-resisting steel of the present invention.

The ferritic steel of the present invention comprises 0.03 to 0.10%, preferably, 0.04 to 0.90%, by weight of carbon, 0.1 to 1.0%, preferably, 0.2 to 0.5%, by weight of silicon, 1.5% by weight or less, preferably, 0.5 to 1.2% by weight, of manganese, 1.5% to 2.7%, preferably, 1.5 to 2.2%, by weight of molybdenum, 7.0% to 10.0%, preferably, 8.0 to 9.5%, by weight of chromium, 0.01 to 0.1%, preferably, 0.02 to 0.06%, by weight of niobium, 0.02 to 0.12%, preferably, 0.05 to 0.10%, by weight of vanadium, 0.01 to 0.10%, preferably, 0.02 to 0.06%, by weight of an alloying element consisting of at least one member selected from the group consisting of rare earth elements having atomic numbers 57 through 71 and yttrium, and the balance consisting of iron and unavoidable impurities.

In the ferritic steel of the present invention, it is important that the ratio of the sum of the numbers of niobium and vanadium atoms to the number of carbon atoms, which will be represented by the atomic ratio (Nb+V)/C, hereinafter, is in the range of from 0.35 to 0.80.

Also, in the ferritic steel of the present invention it is important that the quantity (Cr%/30+Mo%/10−C%) and the alloying element content in % falls on or within the irregular pentagon indicated in FIG. 1, said irregular pentagon being defined by points A, B, C, P and D.

| Coordinate | $\left(\frac{Cr\ \%}{30} + \frac{Mo\ \%}{10} - C\ \%\right)$ | Alloying element (The Sum of REM and Y content) (%) |
|---|---|---|
| A | 0.28 | 0.10 |
| B | 0.28 | 0.01 |
| C | 0.52 | 0.01 |
| P | 0.57 | 0.055 |
| D | 0.52 | 0.10 |

Balance: Fe and inevitable impurities

The reason for the limitations of the respective components are as described hereunder.

Carbon is an effective alloying element for attaining a high mechanical strength of steel. However, an excessive addition of carbon causes degraded weldability and formability. Therefore, the content of carbon in the steel of the present invention should be 0.1% by weight or less. That is, this type of steel has an excellent hardenability because of chromium content as mentioned later, when this steel is subjected to welding, the heat affected zone is remarkably hardened, causing cold cracking during the welding procedure. Accordingly, for a satisfactory weld, the steel to be welded shall be preheated to a significantly high temperature. The preheating reduces markedly the work efficiency in welding. In contrast to this, if the carbon content is controlled to 0.10% by weight or less, the maximum hardness of the heat affected zone is reduced, so that the resultant weld is easily prevented from being cracked. For this reason, the upper limit of the carbon content was controlled to 0.10% by weight. On the other hand, if the carbon content is less than 0.03% by weight, the resultant steel exhibits a poor creep rupture strength. Therefore, the lower limit of the carbon content in the steel of the present invention was controlled to 0.03% by weight.

Silicon is added as a deoxidizing agent for the steel. Silicon is also effective for enhancing the resistance to oxidation of the steel. The upper limit of silicon content was designated to 1.0% to improve oxidation resistance without reducing weldability and toughness, while the lower limit was designated to 0.10% for sufficient deoxidation and sound quality of the resultant steel.

Manganese is effective not only for deoxidation of the steel, but also for enhancing the strength of the steel. However, manganese in an amount exceeding 1.5% by weight causes the resultant steel to exhibit a reduced toughness. Therefore, the content of manganese in the steel of the present invention should be 1.5% by weight or less.

Molybdenum is an effective component for enhancing the mechanical strength of the steel significantly at an elevated temperature by solid solution hardening. Therefore, molybdenum is added for the purpose of increasing the temperature and pressure under which the resultant steel can be used. However, molybdenum is an expensive element and an excessively large amount of molybdenum causes the resultant steel to exhibit an undesirable deterioration of weldability, oxidation resistance and toughness. Therefore, the content of molybdenum in the steel of the present invention should not exceed 2.7% by weight. On the other hand, the addition of molybdenum in an amount of 1.5% by weight or less causes the resultant steel to exhibit little enhanced creep rupture strength. For this reason, the steel of the present invention should contain molybdenum in an amount greater than 1.5% by weight.

Chromium is an essential element for enhancing the resistance of the steel to oxidation. Therefore, a heat-resisting steel necessarily contains a certain amount of chromium. In the ferritic steel of the present invention, the content of chromium is in a range of from 7.0 to 10.0% by weight. A content of chromium less than 7.0% by weight causes the resultant steel to exhibit an unsatisfactory resistance to oxidation. Also, a content of chromium more than 10.0% by weight causes the resultant steel to exhibit an undesirably poor weldability and toughness, particularly an undesirably increased embrittlement during service.

Niobium and vanadium are very important elements for controlling the precipitation condition and dispersion of carbides $M_{23}C_6$ and $M_6C$ (wherein M represents a metallic element), thereby ensuring the strength of the steel at an elevated temperature.

However, when either niobium and vanadium is used singly, it is not satisfactorily effective for controlling precipitation of the carbides thereof. Only the presence of both niobium and vanadium is effective for precisely controlling precipitation and dispersion of carbides, NbC and $V_4C_3$. Also, the combination of noibium and vanadium is effective for controlling the distribution of the fine particles of the successively precipitated carbides, $M_{23}C_6$ and $M_6C$, so that the particles of these carbides are prevented from coarsening after the resultant steel is in service at the operating temperature for a long period of time.

When the atomic ratio of (Nb+V)/C is in a range of from 0.35 to 0.80, the carbides NbC and $V_4C_3$ are precipitated and dispersed in the form of fine particles, which result in a remarkable increase in the creep rupture strength of the resultant steel.

The contents of niobium should be in the range of from 0.01 to 0.1% by weight. If niobium is added in an amount of less than 0.01% by weight, the addition of niobium in combination with vanadium could not provide an adequate shape and dispersion of the carbides, so that an enhanced creep rupture strength can not be attained. On the other hand, if the content of niobium is more than 0.10% by weight, the resultant NbC itself becomes coarse in the presence of vanadium. The NbC in the form of coarse particles has an adverse effect on the shape and dispersion of the other carbides, which results in reduced toughness of the resultant steel. Accordingly, the content of niobium in the steel of the present invention is limited to a range of from 0.01 to 0.10% by weight.

Similarly, the content of vanadium should be in the range of from 0.02 to 0.12% by weight. If vanadium is used in an amount of less than 0.02% by weight, the above mentioned effect based on the combination with niobium cannot be obtained. Also, a content of vanadium more than 0.12% by weight causes the resultant $V_4C_3$ itself to become coarse in the presence of niobium. The $V_4C_3$ in the form of coarse particles has an adverse effect on the shape and dispersion of $M_{23}C_6$ and $M_6C$, which results in reduction of not only the creep rupture strength of the resultant steel, but also the toughness after service for a long period of time. Therefore, the content of vanadium in the steel of the present invention is limited to a range of from 0.02 to 0.12% by weight.

In the ferritic steel of the present invention, the content of the alloying element consisting of at least one member selected from the group consisting of rare earth elements having atomic numbers 57 through 71 and yttrium, should be in the range of from 0.01 to 0.10% by weight. The alloying element has little effect on improving the creep rupture strength of the steel, but is significantly effective on mitigating embrittlement of the steel after service for a long period of time. Therefore, the addition of the alloying element is indispensable for the present invention. However, if the alloying element is used in an excessively large or small amount, the above mentioned effect can not be obtained. That is, if the alloying element is used in an amount of less than 0.01% by weight, no substantial reduction in the embrittlement of the resultant steel can be attained. Also, if the alloying element is used in an amount of more than 0.10% by weight, the above mentioned effect cannot be attained.

The effect of the alloying element on toughness of the steel after service for a long period does not depend only on the total content of the alloying element. The above mentioned effect is also influenced by a basic chemical composition, the metallurgical structure, of the steel. That is, an excessive content of δ ferrite causes reduced toughness of the steel, and also reduces the effect of rare earth elements and yttrium.

The effect of the alloying element is mainly dominated by the contents of chromium, molybdenum and carbon in the steel. Researchers have made various reports on the effective equivalents of these elements from a metallographic point of view. However, the standardized values of these elements have not been proposed as yet. As a result of various experiments, it was found that the effect of the alloying element matches best the structure when (Cr%/30+Mo%/10−C%) is used as the parameter. When the value of (Cr%/30+Mo%/10−C%) exceeds 0.57, the effect of the alloying element is remarkably reduced. Near this upper limit, the effect of rare earth elements and yttrium can not be always expected. The limit value of (Cr%/30+Mo%/10−C%) decreases slightly when the total content of the alloying element deviates from the optimal addition.

The lowest limit of (Cr%/30+Mo%/10−C%) is, in turn, restricted by the allowable minimum of chromium and molybdenum contents and the allowable maximum of carbon content in relation to creep rupture strength and oxidation resistance.

In order to obtain a ferritic steel having satisfactory mechanical strength, resistance to oxidation, weldability, formability and toughness which are well balanced with each other, it is necessary that, in addition to the necessity that the contents of the individual elements should be in the above-specified ranges, the value of (Cr%/30+Mo%/10−C%) and the content of the alloying element should fall on or within the specific irregular pentagon indicated in the rectangular co-ordinate diagram shown in FIG. 1. The rectangular pentagon is defined by A (0.28, 0.10), B (0.28, 0.01), C (0.52, 0.01), P (0.57, 0.055) and D (0.52, 0.10).

The boundaries of the irregular pentagon AB·CPD shown in FIG. 1 is defined as follows.

The straight line AB corresponds to (Cr%/30+Mo%/10−C%)=0.28%. When this value is less than 0.28% even if the total amount of the alloying element is within the range specified by the present invention, the resultant steel exhibits poor creep rupture strength, resistance to oxidation and weldability. The straight lines AD and BC represent the upper limit, 0.10%, and the lower limit, 0.01%, of the total content of the alloying element respectively. The curve CPD is the envelope of the upper limit of (Cr%/30+Mo%/10−C%) within which the structure is ensured by the total content of the alloying element ranging from 0.01 to 0.10%. Point P (0.57, 0.055) of FIG. 1 represents the largest value of (Cr%/30+Mo%/10−C%), 0.57, at which an enhanced toughness can be ensured when the content of the alloying element is an optimal value of 0.055%. Points C and D represent the upper limit of (Cr%/30+Mo%/10−C%), 0.52 when the content of the alloying element is 0.01% and 0.1%, respectively. Under this upper limit, a suitable structure of the resultant steel for attaining the effect of the rare earth elements and yttrium can be ensured.

The features and advantages of a steel of the present invention will be shown by the following example.

The chemical composition, the creep rupture time and elongation under a stress of 18 kg/mm$^2$ at 600° C., the creep rupture strength at 600° C. for 1000 hours, the impact value at 20° C., $vE_{20}$ (kg-m/cm$^2$) after aging at 500° C. for 1000 hours, the preheating temperature for preventing cracking in welding as an index of weldability (Specimen thickness 10 mm), the atomic ratio of (Nb+V)/C and the value of (Cr%/30+Mo%/10−C%) for tested steels are shown in Table 1.

In Table 1, the steel samples H, I, J, K, L, P, R, S, U and A1 are examples of the steels of the present invention and the other samples represent comparative examples as a control.

The steels A through D represent conventional steels in which no combination of niobium with vanadium is added and no alloying element consisting of at least one member selected from the group consisting of the rare earth elements having atomic numbers 57 through 71 and yttrium is added. Among these steels, the steel C is a 2¼Cr-1Mo steel which is usually used as a low alloy heat-resisting steel, and the steel A is an alloy steel suitable for a boiler and a heat exchanger which has an enhanced resistance to corrosion at high temperatures, as compared with the 2¼Cr-1Mo steel. However, the steel A exhibits a poor creep rupture strength. The steel B is a steel in which the creep rupture strength of the steel A is improved. However, the steels A, B and C all exhibit a remarkably poorer creep rupture strength than the steels of the present invention. The steel D is used at present as a material for a superheater tube and a reheater tube of a coal-fired boiler in European countries centering around West Germany. However, the steel D exhibits a poor weldability and formability because the carbon content thereof is far higher than that of the steels of the present invention. On the contrary, the steels of the present invention have a reduced carbon content to improve weldability and formability. Also, the steels of the present invention contain a combination of niobium and vanadium so as to maintain the precipitation and dispersion of the carbides in the best condition, thereby ensuring excellent mechanical strength. Furthermore, the steels of the present invention contain at least one member selected from the group consisting of the rare earth elements having atomic numbers 57 to 71 and yttrium so as to mitigate embrittlement during service.

The comparative steels F and Y are those which have respectively a carbon content deviating from the lower or upper limit of the carbon content of steels of the present invention. The comparative steel F has a remarkably lower creep rupture strength than steel H of the present invention. In welding operation, the comparative steel Y requires to be preheated at a temperature considerably higher than that of steels of the present invention causing difficulties in welding operation.

The atomic ratio of (V+Nb)/C for comparative steels G, M and N deviates from that of steels of the present invention. These comparative steels exhibit a creep rupture strength remarkably lower than that of steels H through L of the present invention.

The comparative steel E contains no member selected from the group consisting of the rare earth elements and yttrium. Also, the comparative steels O and W contain the alloying element in an amount outside the specific range for the steels of the present invention. That is, referring to FIG. 2, the content of the alloying element is below the straight line BC for the comparative steel O and above the straight line AD for the comparative steel W. These comparative steels E, O and W all exhibit a markedly reduced toughness after being heated for a long period of time, as compared with that of the steels A1, J and L of the present invention.

The comparative steels Q, T and V are those whose values of (Cr%/30+Mo%/10−C%) lies in the area on the right side of the curve CPD. These comparative steels exhibit a remarkably increased brittleness after being heated for a long period of time, as compared with that of the steels R, S and U of the present invention.

If high pressure equipment, such as a boiler, is made of these comparative steels exhibiting a remarkable embrittlement, such equipment has a possibility of being ruptured when it is subjected to a hydraulic pressure test in periodical inspection.

The comparative steel X contains molybdenum in an amount less than the lower limit for the present invention. Even if the other conditions are satisfied, such a steel exhibits a remarkably reduced creep rupture strength.

In addition, the comparative steel Z is a steel in which the chromium content is more than the upper limit for the steels of the present invention. In the welding procedure, this comparative steel requires a pre-heating temperature higher than that for steels of the present invention. Further, the toughness of this comparative steel is inferior to that of the steels of the present invention.

Figure 2:
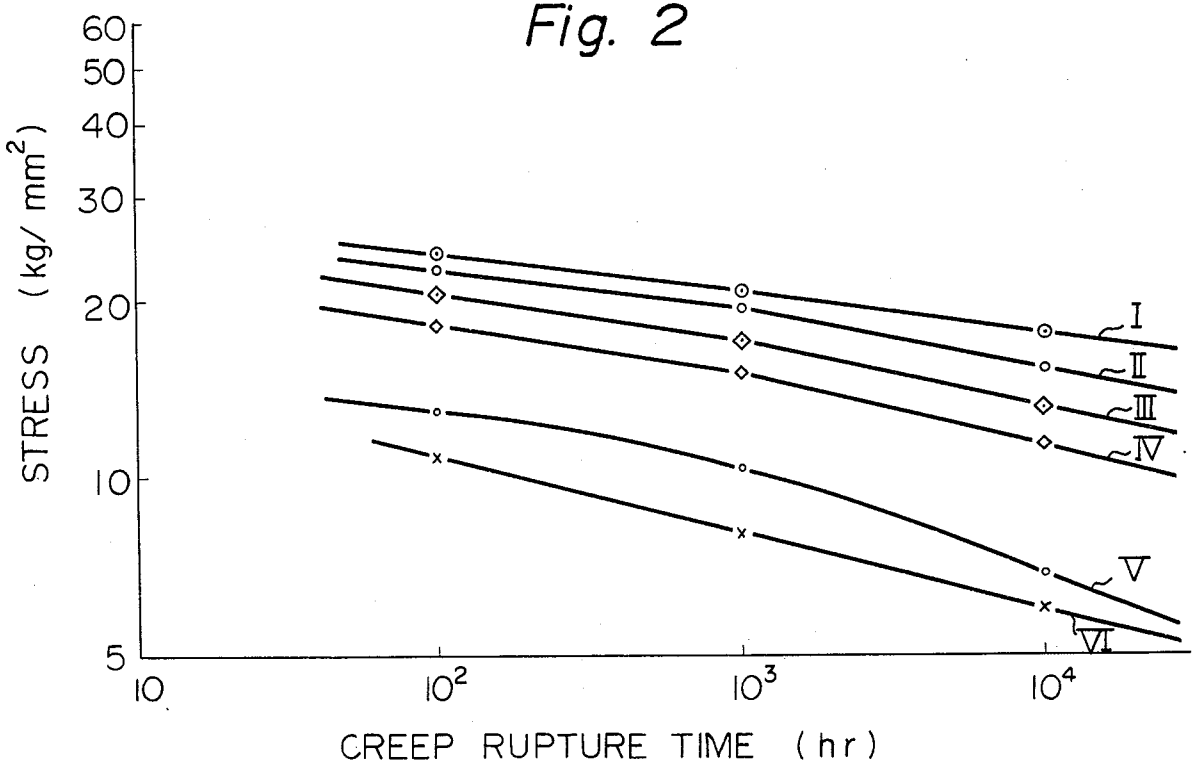
FIG. 2 compares creep rupture strength at 600° C. between other commercially available heat-resisting steels and the steels of the present invention.

FIG. 2 compares the creep rupture strength at 600° C. between steels H, J of the present invention and commercially available steels. In FIG. 2, Curve I indicates a stress-creep rupture time curve of the steel H of the present invention, Curve II indicates that of the steel J of the present invention, Curve III indicates that of a comparative improved 9Cr-Mo steel, Curve IV indicates that of a comparative X20CrMoV-121 steel, Curve V indicates that of a comparative 2¼Cr-1Mo steel and Curve VI indicates that of a comparative 9Cr-1Mo steel.

The creep rupture strengths of the steels of the present invention are higher than that of EM12 (improved 9Cr-Mo steel) made in France and that of X20CrMoV-121 made in Germany, which belong to conventional ferritic heat-resisting steels. In addition, the creep rupture strengths of the steels of the present invention are far superior to that of commercially available 2¼Cr-1Mo steel and 9Cr-1Mo steel. Accordingly, the steels of the present invention can be used at a significantly higher temperature than that at which the comparative steels can be used under a common level of stress.

As is apparent from the above-mentioned example and FIG. 2, the steels according to the present invention exhibit very excellent weldability and mechanical strength at an elevated temperature while maintaining the toughness thereof at a high level, as compared with those of the conventional ferritic steels for a boiler.

TABLE 1

Chemical composition and various properties of the steels tested

| Type of Steel | Content (wt. %) of elements C | Si | Mn | Mo | Cr | Quantity × $\left(\frac{Cr}{30} + \frac{Mo}{10} - C\right)$ | Content (wt. %) of elements Nb | V | Ce | Atomic ratio (Nb + V)/C | Creep rupture property (600° C., 18kg/mm²) Rupture time (hr) | Elongation (%) | 600° C. × 10³h rupture strength (kg/mm²) | vE20 after 600° C. × 10³h (kg.m/cm²) | Pre-heating temperature for welding (°C.) | Within or outside the irregular pentagon defined by A,B,C,P and D as shown in FIG. 1 | Quality of steel |
|---|---|---|---|---|---|---|---|---|---|---|---|---|---|---|---|---|---|
| (*) oA | 0.07 | 0.32 | 0.60 | 1.03 | 9.08 | — | — | — | — | — | less 10 | — | 8.1 | — | 100 | — | Unsatisfactory |
| oB | 0.07 | 0.35 | 0.53 | 2.03 | 9.12 | — | — | — | — | — | less 10 | — | 12.5 | 8.9 | 100 | — | Unsatisfactory |
| oC | 0.10 | 0.32 | 0.48 | 0.96 | 2.14 | — | — | — | — | — | less 10 | — | 10.3 | — | 75 | — | Unsatisfactory |
| oD | 0.19 | 0.22 | 0.59 | 1.00 | 11.54 | — | — | 0.34 | (ni 0.51) | 0.42 | 131 | — | 15.0 | — | 150 | — | Unsatisfactory |
| oE | 0.04 | 0.45 | 0.54 | 1.83 | 8.72 | — | 0.03 | 0.01 | — | 0.31 | 1560 | 45 | — | 2.0 | 75 | — | Unsatisfactory |
| oF | 0.02 | 0.60 | 0.72 | 1.92 | 8.92 | 0.47 | 0.03 | 0.03 | 0.03 | 0.27 | 620 | 40 | — | 3.6 | 75 | within | Unsatisfactory |
| oG | 0.04 | 0.63 | 0.73 | 1.86 | 8.46 | 0.43 | 0.03 | 0.03 | 0.04 | 0.27 | 1400 | 42 | — | 5.9 | 75 | within | Unsatisfactory |
| H | 0.04 | 0.54 | 0.60 | 1.90 | 8.52 | 0.43 | 0.04 | 0.04 | 0.05 | 0.37 | 3410 | 31 | 19.5 | 6.9 | 75 | within | Satisfactory |
| I | 0.04 | 0.50 | 0.63 | 1.80 | 8.47 | 0.42 | 0.04 | 0.05 | 0.04 | 0.42 | 3960 | 28 | — | 7.6 | 75 | within | Satisfactory |
| J | 0.04 | 0.53 | 0.59 | 1.86 | 8.62 | 0.43 | 0.03 | 0.08 | 0.01 | 0.57 | 6230 | 24 | 20.8 | 5.3 | 75 | within | Satisfactory |
| K | 0.04 | 0.53 | 0.64 | 1.80 | 8.70 | 0.43 | 0.06 | 0.08 | 0.03 | 0.67 | 5180 | 26 | — | 5.9 | 75 | within | Satisfactory |
| L | 0.04 | 0.55 | 0.70 | 1.86 | 8.42 | 0.43 | 0.04 | 0.11 | 0.02 | 0.78 | 2910 | 25 | — | 5.8 | 75 | within | Satisfactory |
| oM | 0.04 | 0.53 | 0.58 | 1.79 | 8.72 | 0.43 | 0.09 | 0.09 | 0.04 | 0.82 | 1340 | 25 | — | 5.9 | 75 | within | Unsatisfactory |
| oN | 0.04 | 0.54 | 0.59 | 1.86 | 8.72 | 0.44 | 0.09 | 0.12 | 0.06 | 0.94 | 1400 | 24 | | 7.2 | 75 | within | Unsatisfactory |
| oO | 0.04 | 0.53 | 0.54 | 1.90 | 9.03 | 0.45 | 0.04 | 0.08 | 0.005 | 0.60 | 6180 | 26 | — | 2.1 | 100 | outside | Unsatisfactory |
| P | 0.06 | 0.55 | 0.54 | 1.86 | 8.80 | 0.42 | 0.04 | 0.07 | 0.05 | 0.36 | 2980 | 34 | — | 6.5 | 75 | within | Satisfactory |
| oQ | 0.04 | 0.60 | 0.57 | 2.69 | 9.30 | 0.54 | 0.06 | 0.08 | 0.02 | 0.67 | 5070 | 29 | — | 3.2 | 75 | outside | Unsatisfactory |
| R | 0.05 | 0.62 | 0.56 | 2.50 | 8.99 | 0.52 | 0.06 | 0.09 | 0.02 | 0.58 | 5980 | 28 | — | 5.1 | 75 | within | Satisfactory |
| S | 0.04 | 0.57 | 0.54 | 2.69 | 9.92 | 0.56 | 0.05 | 0.10 | 0.05 | 0.75 | 3010 | 36 | — | 7.2 | 75 | within | Satisfactory |
| oT | 0.04 | 0.52 | 0.56 | 2.67 | 10.50 | 0.58 | 0.04 | 0.11 | 0.06 | 0.78 | 2760 | 34 | — | 2.8 | 75 | outside | Unsatis- |

TABLE 1-continued

Chemical composition and various properties of the steels tested

| Type of Steel | Content (wt. %) of elements C | Si | Mn | Mo | Cr | Quantity × $\left(\frac{Cr}{30} + \frac{Mo}{10} - C\right)$ | Content (wt. %) of elements Nb | V | Ce | Atomic ratio (Nb + V)/C | Creep rupture property (600° C., 18kg/mm²) Rupture time (hr) | Elongation (%) | 600° C. × $10^3$h rupture strength (kg/mm²) | vE20 after 600° C. × $10^3$h (kg.m/cm²) | Pre-heating temperature for welding (°C.) | Within or outside the irregular pentagon defined by A,B,C,P and D as shown in FIG. 1 | Quality of steel |
|---|---|---|---|---|---|---|---|---|---|---|---|---|---|---|---|---|---|
| | | | | | | | | | | | | | | | | | factory |
| U | 0.05 | 0.62 | 0.58 | 2.67 | 8.98 | 0.52 | 0.06 | 0.10 | 0.085 | 0.63 | 5750 | 24 | — | 7.7 | 75 | within | Unsatisfactory |
| oV | 0.04 | 0.63 | 0.59 | 2.50 | 9.89 | 0.54 | 0.04 | 0.10 | 0.09 | 0.72 | 4030 | 32 | — | 2.7 | 75 | outside | Unsatisfactory |
| oW | 0.05 | 0.62 | 0.61 | 1.80 | 8.70 | 0.42 | 0.06 | 0.10 | 0.11 | 0.63 | 5820 | 28 | — | 3.0 | 75 | outside | Unsatisfactory |
| oX | 0.04 | 0.59 | 0.59 | 1.39 | 8.70 | 0.39 | 0.04 | 0.06 | 0.05 | 0.48 | 1480 | 29 | — | 5.0 | 75 | within | Unsatisfactory |
| oY | 0.12 | 0.58 | 0.63 | 1.85 | 8.80 | 0.36 | 0.05 | 0.07 | 0.05 | 0.19 | 1290 | 31 | — | 2.1 | 150 | within | Unsatisfactory |
| oZ | 0.04 | 0.62 | 0.59 | 1.87 | 11.60 | 0.53 | 0.04 | 0.07 | 0.06 | 0.54 | 2900 | 32 | — | 3.6 | 100 | within | Unsatisfactory |
| Al | 0.04 | 0.58 | 0.57 | 2.00 | 8.70 | 0.45 | 0.04 | 0.08 | 0.095 | 0.60 | 6050 | 25 | — | 5.2 | 75 | within | Satisfactory |

Note:
o mark: A~G, M~O, Q, T and V~Z: Comparative steels H~L, P, R~S, U and Al: Steels of the present invention

We claim:

1. A ferritic heat-resisting steel having a carbon content lowered to not more than 0.10% by weight so as to provide the steel with weldability and formability that is enhanced as compared to it having higher carbon content, and containing carbide particles which are controlled so as to provide the steel with the mechanical and creep strength of said steel of higher carbon content and having a toughening alloying element giving the steel greater toughness than it has without said element, said steel consisting essentially of the following:

0.03 to 0.10% by weight of carbon, 0.1 to 1.0% by weight of silicon, 1.5% by weight or less of manganese, 1.5% to 2.7% by weight of molybdenum, 7.0% to 10.0% by weight of chromium, 0.01 to 0.1% by weight of niobium, 0.02 to 0.12% by weight of vanadium, 0.01 to 0.10% by weight of said toughening alloying element and which consists of at least one member selected from the group consisting of rare earth elements having atomic numbers 57 through 71 and yttrium, the balance of the steel consisting of iron and unavoidable impurities, the ratio of the sum of the numbers of niobium and vanadium atoms to the number of carbon atoms being in the range of from 0.35 to 0.80; and the quantity ($Cr\%/30+Mo\%/10-C\%$) and the content in percent of said alloying element falling on or within an irregular pentagon shown in FIG. 1 hereof, said irregular pentagon being defined by points of A, B, C, P and D,

| Coordinate | $\left(\frac{Cr\ \%}{30}+\frac{Mo\ \%}{10}-C\ \%\right)$ | Alloying element (The Sum of REM and Y content) (%) |
|---|---|---|
| A | 0.28 | 0.10 |
| B | 0.28 | 0.01 |
| C | 0.52 | 0.01 |
| P | 0.57 | 0.055 |
| D | 0.52 | 0.10 |

2. The ferritic heat-resisting steel as claimed in claim 1 wherein the content of carbon is in the range of from 0.04% to 0.09% by weight.

3. The ferritic heat-resisting steel as claimed in claim 1 wherein the content of silicon is in the range of from 0.2% to 0.5% by weight.

4. The ferritic heat-resisting steel as claimed in claim 1 wherein the content of manganese is in the range of from 0.5% to 1.2% by weight.

5. The ferritic heat-resisting steel as claimed in claim 1 wherein the content of molybdenum is in the range of from 1.5% to 2.2% by weight.

6. The ferritic heat-resisting steel as claimed in claim 1 wherein the content of chromium is in the range of from 8.0% to 9.5% by weight.

7. The ferritic heat-resisting steel as claimed in claim 1 wherein the content of niobium is in the range of from 0.02% to 0.06% by weight.

8. The ferritic heat-resisting steel as claimed in claim 1 wherein the content of vanadium is in the range of from 0.05% to 0.10% by weight.

9. The ferritic heat-resisting steel as claimed in claim 1 wherein the content of said alloying elements is in the range of from 0.02% to 0.06% by weight.

* * * * *

UNITED STATES PATENT AND TRADEMARK OFFICE

CERTIFICATE OF CORRECTION

PATENT NO. : 4,405,369

DATED : September 20, 1983

INVENTOR(S) : Yasuo Otoguro, et al.

It is certified that error appears in the above—identified patent and that said Letters Patent is hereby corrected as shown below:

Col. 3, line 49, change "0.90%" to --0.09%--.

Signed and Sealed this

*Twenty-second* Day of *November 1983*

[SEAL]

*Attest:*

GERALD J. MOSSINGHOFF

*Attesting Officer*

*Commissioner of Patents and Trademarks*